US006199476B1

(12) United States Patent
Kayser

(10) Patent No.: US 6,199,476 B1
(45) Date of Patent: Mar. 13, 2001

(54) ROLL MACHINE AND PROCESS FOR OPERATING THE SAME

(75) Inventor: Franz Kayser, Geldern (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/280,395

(22) Filed: Apr. 5, 1999

(30) Foreign Application Priority Data

Apr. 6, 1998 (DE) ..... 198 15 339

(51) Int. Cl.[7] ..... B30B 3/04; D21G 1/00

(52) U.S. Cl. ..... 100/35; 72/10.2; 72/249; 100/47; 100/172; 226/42; 226/788

(58) Field of Search ..... 100/35, 47, 162 R, 100/172, 173; 72/8.3, 10.2, 249; 226/42, 111, 181, 188

(56) References Cited

U.S. PATENT DOCUMENTS

| | | | | |
|---|---|---|---|---|
| 1,925,866 | * | 9/1933 | Drake | 100/172 |
| 3,044,392 | * | 7/1962 | Minarik | 100/172 |
| 3,172,315 | * | 3/1965 | Fox | 100/47 |
| 4,179,330 | * | 12/1979 | Page | 100/172 |
| 4,471,690 | | 9/1984 | Yamaguchi et al. . | |
| 4,566,299 | * | 1/1986 | Koyama et al. | 72/10.2 |
| 5,222,679 | | 6/1993 | Dropczynski et al. . | |
| 5,413,656 | | 5/1995 | Kühnhold et al. . | |
| 5,784,955 | * | 7/1998 | Conrad | 100/172 |
| 5,795,432 | | 8/1998 | Urban . | |
| 6,095,039 | * | 8/2000 | Brendel et al. | 100/172 |

FOREIGN PATENT DOCUMENTS

| | | |
|---|---|---|
| 4322991 | 1/1994 | (DE) . |
| 29518424 | 4/1996 | (DE) . |
| 19601293 | 7/1997 | (DE) . |
| 19650576 | 6/1998 | (DE) . |
| 0442038 | 8/1991 | (EP) . |
| 0512196 | 11/1992 | (EP) . |
| 2625486 | 7/1989 | (FR) . |
| 1156937 | 7/1969 | (GB) . |
| 92/05100 | 4/1992 | (WO) . |
| 98/17564 | 4/1998 | (WO) . |

OTHER PUBLICATIONS

"Vermeidung von Glättwerkmarkierungen im Papier mit Escher Wyss Nipco Walzen" (Preventing Calender Stack Markings in Paper with Escher Wyss Nipco Rolls), Technische Rundschau Sulzer, published Feb. 1977.

"Barringbildung am Glättkalander einer Papiermaschine" (Barring Formation in the Calendar Stack of a Paper Making Machine) by M. Hermanski, Das Papier, vol. 9, published 1995.

ACS 600 Drives with Direct Torque Control [Antriebe mit direkter Drehmomentregelung], ABB Technik Jun. 1997, pp. 31–39.

Reduction of Chatter Marks in the Shaping of Steel Bands [Verminderung von Rattermarken beim Dressieren von Stahlbändern], Steel and Iron [Stahl und Eisen] 11(1998), No. 3, pp. 69–72.

* cited by examiner

*Primary Examiner*—Stephen F. Gerrity
(74) *Attorney, Agent, or Firm*—Greenblum & Bernstein P.L.C.

(57) ABSTRACT

A roll machine is provided. A plurality of rolls are disposed in a stack to define a plurality of nips therebetween adapted to treat a material web. At least two of the plurality of rolls are driven rolls. A drive control commonly controls the driven rolls. The drive control varies a driving torque distribution of the driven rolls over time. A method for operating the above roll machine is also provided, where the method includes changing a driving torque distribution of said driven rolls.

34 Claims, 4 Drawing Sheets

| # | TIME (h:min) | ROLL #1 | | | ROLL #2 | | | ROLL #3 | | |
|---|---|---|---|---|---|---|---|---|---|---|
| | | (kW) | (%) | (%) | (kW) | (%) | (%) | (kW) | (%) | (%) |
| 1 | 8:23 | 149.94 | 47.6 | 11.5 | 21.01 | 19.1 | 1.6 | 10.99 | 29.7 | 0.8 |
| 2 | 14:37 | 193.1 | 61.3 | 14.9 | 64.02 | 58.2 | 4.9 | 21.02 | 56.8 | 1.6 |
| 3 | 5:19 | 184.91 | 58.7 | 14.2 | 88 | 80 | 6.8 | 33 | 89.2 | 2.5 |
| 4 | 9:41 | 155.93 | 49.5 | 12 | 92.95 | 84.5 | 7.2 | 35 | 94.6 | 2.7 |
| 5 | 13:06 | 113.09 | 35.9 | 8.7 | 32.01 | 29.1 | 2.5 | 17.98 | 48.6 | 1.4 |
| 6 | 8:07 | 106.16 | 33.7 | 8.2 | 41.03 | 37.3 | 3.2 | -5 | -13.5 | -0.4 |
| 7 | 9:17 | 63 | 20 | 4.8 | 86.02 | 78.2 | 6.6 | 8.99 | 24.3 | 0.7 |
| 8 | 14:53 | 43.16 | 13.7 | 3.3 | 103.95 | 94.5 | 8 | 21.02 | 56.8 | 1.6 |
| 9 | 6:49 | 36.86 | 11.7 | 2.8 | 100.98 | 91.8 | 7.8 | 4 | 10.8 | 0.3 |
| 10 | 4:11 | 86 | 27.3 | 6.6 | 94.05 | 85.5 | 7.2 | 26.01 | 70.3 | 2 |
| 11 | 8:31 | 108.05 | 34.3 | 8.3 | 86.02 | 78.2 | 6.6 | 8.99 | 24.3 | 0.7 |
| 12 | 6:21 | 171.05 | 54.3 | 13.2 | -14.96 | -13.6 | -1.2 | 10.99 | 29.7 | 0.8 |
| 13 | 13:15 | 89.15 | 28.3 | 6.9 | -6.05 | -5.5 | -0.5 | 21.02 | 56.8 | 1.6 |
| 14 | 15:46 | 164.12 | 52.1 | 12.6 | -11.99 | -10.9 | -0.9 | 32.01 | 86.5 | 2.5 |
| 15 | 10:03 | 120.02 | 38.1 | 9.2 | 104.5 | 95 | 8 | 26.01 | 70.3 | 2 |
| 16 | 7:37 | 183.02 | 58.1 | 14.1 | -1.98 | -1.8 | -0.2 | 34 | 91.9 | 2.6 |
| 17 | 3:21 | 217.04 | 68.9 | 16.7 | 0 | 0 | 0 | 22.02 | 59.5 | 1.7 |
| 18 | 10:57 | 250.11 | 79.4 | 19.2 | 11 | 10 | 0.8 | 5 | 13.5 | 0.4 |
| 19 | 12:51 | 246.02 | 78.1 | 18.9 | 32.01 | 29.1 | 2.5 | 35 | 94.6 | 2.7 |
| 20 | 11:26 | 193.1 | 61.3 | 14.9 | 43.01 | 39.1 | 3.3 | 14.99 | 40.5 | 1.2 |

FIG. 4A

| ROLL #4 | | | ROLL #5 | | | ROLL #6 | | |
|---|---|---|---|---|---|---|---|---|
| (kW) | (%) | (%) | (kW) | (%) | (%) | (kW) | (%) | (%) |
| 22.16 | 59.9 | 1.7 | 911.3 | 82.8 | 70.1 | 185.85 | 59 | 14.3 |
| 32.01 | 86.5 | 2.5 | 760.5 | 69.1 | 58.5 | 229.01 | 72.7 | 17.6 |
| 35 | 94.6 | 2.7 | 750.1 | 68.2 | 57.7 | 208.85 | 66.3 | 16.1 |
| 25.01 | 67.6 | 1.9 | 739.7 | 67.2 | 56.9 | 251.06 | 79.7 | 19.3 |
| 33 | 89.2 | 2.5 | 950.3 | 86.4 | 73.1 | 154.04 | 48.9 | 11.8 |
| 24.01 | 64.9 | 1.8 | 989.3 | 89.9 | 76.1 | 143.96 | 45.7 | 11.1 |
| 10.99 | 29.7 | 0.8 | 1030.9 | 93.7 | 79.3 | 101.12 | 32.1 | 7.8 |
| -10.99 | -29.7 | -0.8 | 1080.3 | 98.2 | 83.1 | 63 | 20 | 4.8 |
| 11.99 | 32.4 | 0.9 | 1090.7 | 99.2 | 83.9 | 56.07 | 17.8 | 4.3 |
| -7.99 | -21.6 | -0.6 | 1069.9 | 97.3 | 82.3 | 32.13 | 10.2 | 2.5 |
| 17.98 | 48.6 | 1.4 | 1050.4 | 95.5 | 80.8 | 28.98 | 9.2 | 2.2 |
| 26.01 | 70.3 | 2 | 1060.8 | 96.4 | 81.6 | 46.94 | 14.9 | 3.6 |
| 32.01 | 86.5 | 2.5 | 1099.8 | 100 | 84.6 | 63.95 | 20.3 | 4.9 |
| 29.01 | 78.4 | 2.2 | 999.7 | 90.9 | 76.9 | 86.94 | 27.6 | 6.7 |
| 33 | 89.2 | 2.5 | 921.7 | 83.8 | 70.9 | 96.08 | 30.5 | 7.4 |
| 12.99 | 35.1 | 1 | 839.8 | 76.3 | 64.6 | 232.16 | 73.7 | 17.9 |
| 33.78 | 91.3 | 2.6 | 839.8 | 76.3 | 64.6 | 187.11 | 59.4 | 14.4 |
| 32.01 | 86.5 | 2.5 | 800.8 | 72.8 | 61.6 | 201.92 | 64.1 | 15.5 |
| 22.02 | 59.5 | 1.7 | 739.7 | 67.2 | 56.9 | 224.91 | 71.4 | 17.3 |
| 0 | 0 | 0 | 868.4 | 78.9 | 66.8 | 178.92 | 56.8 | 13.8 |

FIG. 4B

ROLL MACHINE AND PROCESS FOR OPERATING THE SAME

CROSS REFERENCE TO RELATED APPLICATIONS

The present application claims priority under 35 U.S.C. §119 of German Patent Application No. 198 15 339.2, filed Apr. 6, 1998, the disclosure of which is expressly incorporated by reference herein in its entirety.

BACKGROUND OF THE INVENTION

1. Field of the Invention

The present invention is directed to a roll machine for manufacturing or treating a material web. More specifically, the present invention is directed to a roll machine with a number of rolls that are disposed in a stack and form a number of nips therebetween for treating or manufacturing a material web, where at least two of the rolls are driven. The present invention also relates to a process for operating such a roll machine.

2. Discussion of the Background Information

DE 295 18 424 U1 discloses a roll machine, particularly a calender. The drive devices of the rolls control the individual rolls to match the speed of the web traveling through before the nips are closed. This matching of speed prevents a speed differential when the nips are closed on the web that might otherwise stress or tear the web.

Such a roll machine can be used both as a calender and as a calender stack, preferably for the treatment or manufacture of a paper web. The paper web is subjected to a certain pressure in the nips between adjacent rolls for several purposes, including evening out irregularities in the surface of the paper web, compressing the paper web, and providing the surface of the paper web with a desired smoothness and/or a desired gloss.

Other material webs, for example made of plastic or aluminum, can also be treated in a similar manner in calenders or calender stacks.

In any case, a drawback of this prior art roll machine is that, after a certain operating time, lateral stripes of varying gloss form on the material web. Material webs with such lateral strips, known in the industry as "barring," cannot be used and are discarded. The corresponding roll must also be replaced or refinished.

The cause of barring has not yet been conclusively identified. One possible cause is initial defects, such as thickness fluctuations in the material web resulting from a periodically fluctuating headbox, cause the rolls and/or their jackets to oscillate at their natural frequency. This can consequently form markings in the surface of one or more rolls, and gradually cause a roll to become polygonal rather than cylindrical. This leads to a corresponding repercussion in the material web so that the polygon shape becomes even more pronounced over time. The lateral strips then become visible after a certain point.

In addition, a polygonal roll produces oscillations that propagate through the entire roll machine, causing malfunctions in other nips. Such oscillations are investigated, for example, in "Barringbildung am Glättkalander einer Papiermaschine" (Barring Formation in the Calender Stack of a Paper Making Machine) by M. Hermanski, Das Papier, Vol. 9, 1995, pp. 581–590. A solution of using more wear resistant surfaces of the roll covers of the soft rolls has been proposed. In "Vermeidung von Glättwerkmarkierungen im Papier mit Escher Wyss Nipco-Walzen" (Preventing Calender Stack Markings in Paper with Escher Wyss Nipco Rolls), Technische Rundschau Sulzer February 1977, pp. 83–89, the authors ascribe the formation of barring to oscillations of the roll machine and propose employing a particularly well-damped roll, namely the Nipco roll, to reduce oscillations.

Nevertheless, barring can be observed even with more wear resistant roll covers and with the use of deflection adjustment rolls with hydrostatically functioning support shoes.

SUMMARY OF THE INVENTION

Accordingly, the present invention overcomes the drawbacks of the prior art.

Further, the invention is directed to providing a roll machine and a corresponding method of operation of the roll machine to prevent or reduce the onset of barring.

According to the features of the present invention, a roll machine is provided having several rollers, some of which are driven. The driven rolls have a common drive control that varies the driving torque distribution of the driven rolls.

The conclusion that the present invention will prevent or reduce barring is derived from experience, which has shown that a barring formation only occurs after a certain service life of the rolls and roll machine. The formation of barring during the initial use of new or refinished rolls is extremely rare. It is therefore a logical conclusion that the onset of barring results from slowly occurring changes in the rolls. These changes are believed to arise due to a uniform operation of the device over a longer period of time. Such uniform operation is quite desirable in the production of continuous material webs.

A certain driving torque is required for the operation of a roll machine. This driving torque must, for example, overcome the friction of the rolls on the bearings. In the prior art, only one roll was driven in calenders or calender stacks, while the other rolls were carried along with it. It has been observed that rolls carried along, i.e., the rolls that do not have their own drive devices, deflect and "buckle out" from the roll stack.

The addition of at least another drive source reduces the tangential forces responsible for the bending the rolls, and can go as far as to reduce these forces to zero (or to even reverse their direction). Changing the driving torques of the driven rolls can therefore also reduce the "geometry" of the roll stack. If this change in torque occurs before the roll changes that cause barring become distinct, then these roll changes are transformed again. These roll changes do not necessarily have to cancel each other. However, another change is required before these transformations will lead to the barring formation.

In many cases, changing the driving torques of the individual rolls can also achieve a small, but perceptible, phase shift of the individual rolls in relation to one another. This also leads to an "interference" of the uniform operation, which "interferes" with long-term roll changes.

The variation of the driving torque is, of course, limited. For example, the sum of the driving torques applied to different rolls must be sufficient to operate the roll machine. The difference between the driving torques must not be so great that the material web tears. Otherwise, the distribution of the driving torques among the individual rolls is essentially arbitrary. This is also the case when more than two rolls are driven.

Advantageously, the drive control for the driven rolls includes a random generator. With the aid of the random generator, the distribution of driving torques between rolls can be varied without any periodic operation in this variation which could in turn lead to a barring formation. The random generator can either act directly on the driving torque distribution, or the control can evaluate functions with which the driving torque distribution is varied.

The drive control preferably has a limiter, which keeps the rate at which driving torque for any particular roll is changed below a predetermined value. Jumps in the driving torque of a roll (i.e., high rates of change in the driving torque) could tear or damage the material web.

The drive control also preferably connects to a sensor device that detects at least one property of the material web and/or at least one operating parameter of the machine, and changes the driving torque distribution between rolls as a function of at least one output signal of the sensor device. The barring formation can already be detected in its developing stages with appropriate sensors. For example, with suitable sensors, barring can be detected before they are visible to the naked eye. Another possibility is that oscillations of the roll machine are detected, which increase with the onset of barring. In each of these cases, the drive control can respond by changing the distribution of driving torques to the driven rolls before the barring formation actually becomes so noticeable that the material web is no longer usable.

Preferably, the drive control has a timer. Particular time blocks can be adjusted in which the driving torque distribution is constant. A change in the driving torque distribution can be carried out after the expiration of such a time block.

The drive control can have a memory in which at least one change function is stored. The driving torque distribution can, for example, be changed in accordance with this change function. In the alternative, the driving torque distribution can be guided in accordance with the change function after the expiration of an above-mentioned time block.

It is also possible that the drive control has a function generator to produce a driving torque change function. The function generator can then produce functions in conjunction with a random generator, which carries out a change in the driving torque distribution so that conditions either cannot repeat at all or can only do so at relatively large time intervals.

Preferably, two rolls are driven, which are spaced apart by 2+n intervening rolls, where n is a nonnegative integer. By way of non-limiting example, two neighboring rolls can be driven that are separated from each other by 2, 4, 6, etc. rolls. This embodiment assures that the deflection of the rolls caused by the individual drive devices always occurs in opposite directions.

Preferably, the rolls have at least two different diameters. This prevents a pattern of repetition in which a slightly thicker defective spot on one roll, for example caused by its being soiled, always presses against the same spot on the opposing roll. This phenomenon is therefore prevented from building up or inducing oscillations.

Another measure which has a relatively great effect on the operating behavior of the roll machine is the speed of the material web traveling through the roll machine. The speed has a direct effect on the rotating speed of the rolls, and therefore on the oscillations that are caused by the rotation of the rolls. A speed control device can therefore also be provided for the material web. The stationary operation can also be "interfered with" by changing these measures.

As a feature of the present invention, the axis of at least one roll is disposed outside of a plane defined by the axes of two neighboring rolls. This achieves a phase shifting between two nips, which is favorably effective if the material web emerges from the production machine, for example the paper making machine, already having periodic density or thickness fluctuations.

DE 196 01 293 A1 discloses the advantages if a web travel guidance device is disposed before a nip and its distance from the nip can be changed, and provides a device for the same. Here, too, the operation can be somewhat "interfered with" to hinder a buildup of negative deformations of the rolls.

In accordance with the features of the present invention, a driving torque distribution of the driven rolls may be changed. As discussed above, this process interferes with uniform operation of the machine which, for whatever concrete reasons, always leads to barring. The interference generated by the present invention interrupts this buildup before it can produce visible effects in the material web.

Preferably, the driving torque distribution is changed during operation, such that change can be implemented without shutting the roll machine down. This has the further advantage that the same or similar operating conditions as before the change are not accidentally obtained when the roll machine is started again, particularly for oscillations.

The driving torque distribution is preferably kept constant for predetermined time segments and is then changed. The time segments in this connection are small so that with a relatively high degree of certainty, a barring formation cannot yet be observed. However, they otherwise permit an unchanged operation with constant parameters over the time segments mentioned. In the alternative, the driving torque distribution can be changed continuously. In this instance, the roll machine does not have the opportunity to develop malfunctions in a stable or stationary operation.

In another alternative, the driving torque distribution is kept constant until a malfunction parameter exceeds a predetermined value, e.g., when a particular oscillation amplitude is reached or with the occurrence of a not yet visible barring on the material web. The driving torque distribution is changed as the situation or events dictate.

As noted above, the rate of change between different torques is maintained below a predetermined value. This prevents sudden or abrupt torque changes, which can tear the material web.

The change in the driving torque distribution preferably occurs in accordance with the randomness principle. In so doing, there is a low probability that the same driving torque distribution will repeat (although it is possible that they will repeat, such that there will be no effective change in driving torque distribution). With a much greater probability, these repetitions can follow one another at very long time intervals, in which other operating conditions have prevailed during the intervening times. This minimizes the possibility of the onset of malfunctions which induce barrings.

The speed of the material web can also be changed. As mentioned above, this is also a very significant intervention into the operating behavior of the roll machine, which leads to a change in the conditions that lead to the development of barring.

According to an exemplary embodiment of the present invention, there is provided a roll machine. A plurality of rolls are disposed in a stack to define a plurality of nips therebetween adapted to treat a material web. At least two of the plurality of rolls are driven rolls. A drive control commonly controls the driven rolls. The drive control varies a driving torque distribution of the driven rolls over time.

The exemplary embodiment has several features. The drive control may include a random generator. The drive control may also include a limiter that maintains a transition rate between changes of the driving torque distribution below a predetermined value. A sensor device may detect at least one of at least one property of the material web and at least one operating parameter of the roll machine, and the drive control changes the driving torque distribution responsive to at least one output signal of the sensor device. The drive control may include a timer. The drive control may have a memory in which at least one program for the driving torque distribution is stored. The drive control may have a function generator for generating a driving torque change function.

The exemplary embodiment may also have other various features. Two driven rolls may be provided and spaced apart by 2+n rolls of the plurality of rolls, where n is a nonnegative integer. At least one of the plurality of rolls preferably has a different diameter than others of the plurality of rolls.

According to a still further feature of the exemplary embodiment, a supply device feeds the material web. A receiving feeding device receives the material web. A control device controls the supply device and the receiving device to control a speed at which the material web moves through the roll machine.

According to a yet still further feature of the exemplary embodiment, at least one roll of the plurality of rolls is disposed with its axis outside a plane defined by axes of two neighboring rolls of the plurality of rolls.

A web guide device may be disposed upstream of a nip formed between two adjacent rolls of the plurality of rolls, such that a distance between the web guide device and the nip is adjustable.

According to another embodiment of the present invention, a roll machine includes a plurality of rolls formed in a stack to define a plurality of nips therebetween, at least two of the plurality of rolls being driven rolls, and a drive control which commonly controls the driven rolls. A method for operating the roll machine includes changing a driving torque distribution of the driven rolls.

The above embodiment preferably has several features. The changing may occur while the roll machine is operating. The method may include maintaining the driving torque distribution before and after the changing. The changing may occur continuously. The method may include detecting at least one property of the roll machine, such that the changing occurs responsive to the detecting identifying an irregularity in the at least one property.

In the above embodiment, a transition speed of the changing preferably does not exceed a predetermined value.

According to a further feature of the above embodiment, the method includes randomly determining another drive torque distribution, in which the changing changes a current driven torque distribution to the another driving torque distribution.

In another feature of the above embodiment, the method includes adjusting a speed of the material web through the roll machine.

According to another embodiment of the present invention, a roll machine is provided. A plurality of rolls are provided, and at least two of the rolls are driven rolls. A drive control sets at least first and second driving torque distributions for the driven rolls. For each of the at least first and second torque distributions, the driving control causes each of the driven rolls to operate at a driving torque which is less then 100% of torque necessarily to properly operate the roll machine, and to collectively operate at a driving torque which is at least 100% of torque necessary to properly operate the roll machine.

The drive control of the above embodiment can drive the driven rolls at the first driving torque distribution for a first period of time, and then control the driven rolls at the second driving torque distribution for a second period of time. The plurality of rolls preferably at least transport a material web, the first and second periods of time are preferably separated by a third period of time, and the third period of time is preferably long enough to allow the driven rolls to change from the first driving torque distribution to the second driving torque distribution without damaging the material web.

According to still another feature of the above embodiment, the driving control includes a random generator, and at least one of the first and second driving torque distributions is at least partially based on an output of the random generator.

According to another embodiment of the present invention, there is provided a roll machine for at least moving a material web. A plurality of rolls, including at least first and second driven rolls are provided. The at least first and second rolls collectively provide at least sufficient torque to properly move the material web through the roll machine, and individually provide at least a portion of the at least sufficient torque. A torque provided by each of the first and second driven rolls changes over time.

In accordance with another embodiment of the present invention, there is provided a method for operating a roll machine for at least moving a material web, the roll machine including a plurality of rolls including at least two driven rolls. The method includes collectively driving the at least two driven rolls to provide at least a proper operating torque required to properly move the material web through the roll machine, distributing the at least proper operating torque amongst the at least two driven rolls, in which each of the at least two driven rolls provides at least a portion of the proper operating torque.

The above method further includes redistributing the proper operating torque amongst the at least two driven rolls, in which each of the at least two driven rolls provides at least a portion of the proper operating torque, such that at least one of the at least two driven rolls provides a different amount of torque then before the redistribution.

According to another embodiment of the present invention, there is provided a method for operating a roll machine for at least moving a material web, the roll machine including a plurality of rolls including at least two driven rolls. The method includes first establishing a first driving torque distribution between the at least two rolls such that the at least two driven rolls can collectively provide at least a proper operating torque required to properly move the material web through the roll machine, and individually can provide at least a portion of the proper operating torque, and first driving the at least two driven rolls in accordance with the first driving torque distribution.

The above method further includes second establishing a second driving torque distribution between the at least two rolls such that the at least two driven rolls can collectively provide at least a proper operating torque required to properly move the material web through the roll machine, and individually can provide at least a portion of the proper operating torque, transitionally driving the at least two driven rolls from the first driving torque distribution to the second driving torque distribution, and second driving the at least two driven rolls at the second driving torque distribution, in which the first and second driving torques differ such that at least one of the at least two driven rolls is driven at different torques during the first and second driving.

According to another feature of the above embodiment, at least one of the establishing the first driving torque distribution and the establishing a second driving torque distribution is based at least partially on randomly generated parameters. In another feature, the method includes detecting whether an abnormal condition exists, and the second establishing is responsive to a positive output of the detecting. In still another feature, the first driving occurs over a first period of time, the second driving occurs over a second period of time, and the transitionally driving occurs over a third period of time between the first and second periods of time, the third period of time being sufficiently long to prevent damage to the material web. At least one of the first and second periods of time is preferably predetermined, or predetermined.

According to another embodiment of the present invention, a method for operating a roll machine is provided for at least moving a material web, the roll machine comprising a plurality of rolls including at least two driven rolls. The method includes driving the at least two driven rolls in accordance with a driving torque distribution, establishing the driving torque distribution such that the at least two driven rolls collectively provide a proper operating torque to operate the roll machine, and individually provide at least a portion of the proper operating torque, and changing the driving torque distribution over time.

BRIEF DESCRIPTION OF THE DRAWINGS

The present invention is further described in the detailed description that follows, in reference to the noted plurality of drawings by way of non-limiting examples of exemplary embodiments of the present invention, in which like reference numerals represent similar parts through the several views of the drawings, and wherein:

FIGS. 4A and 4B are portions of a table of parameters used to control driven rolls in an embodiment of the present invention.

DETAILED DESCRIPTION OF THE INVENTION

The particulars shown herein are by way of example and for purposes of illustrative discussion of the exemplary embodiments of the present invention only, and represents in the cause of providing what is believed to be the most useful and readily understood description of the principles and conceptual aspects of the invention. In this regard, no attempt is made to show structural details of the invention in more detail than necessary for the fundamental understanding of the invention, the description taken with the drawings making apparent to those skilled in the art how the several forms of the invention may be embodied in practice.

Figure 1:
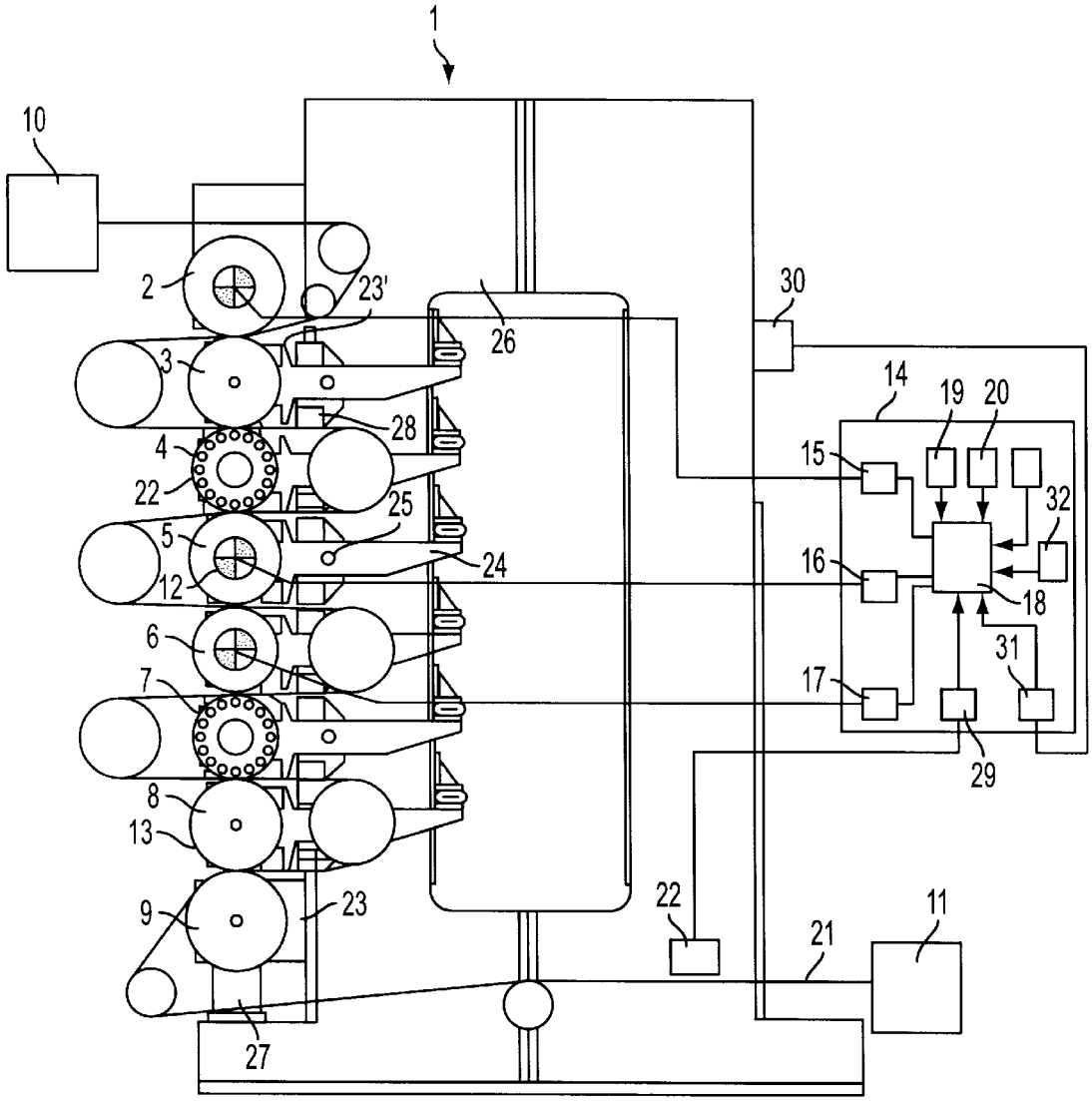
FIG. 1 shows an exemplary embodiment of a roll machine according to the present invention.

Referring now to FIG. 1, a roll machine of the present invention is shown as used in a calender 1. Calender 1 has eight rolls 2–9 of which four rolls 2, 4, 7, 9 have a hard metallic surface and four rolls 3, 5, 6, 8 have an elastic plastic cover 13. All of rolls 2–9 are supported by their roll pins (not shown) in bearing housings 23 and 23'. The bearing housings 23' of the center rolls 3–8 are attached to levers 24 whose rotation points 25 are situated on a calender frame 26. A hydraulic cylinder 27 is provided beneath the roll stack (defined by rolls 2–9) which exerts the necessary force to close the nips between adjacent rolls. Cylinder 27 can also lower the bottom roll 9, moving levers 24 to rest against stops 28 in such a way that gaps of approximately 1–10 mm form between adjacent rolls.

The two center rolls 4 and 7 can be supplied with hot steam. The steam passes through peripheral bores 22 to transfer the heat to rolls 4 and 7.

A supply device 10 and a receiving device 11, represented schematically, are provided upstream and downstream from rolls 2–9. By way of non-limiting example, supply device can be an unwinding station and receiving device 11 can be a winding station. Also by way of non-limiting example, supply device 10 and receiving device 11 can be known components in a paper making machine.

In FIG. 1, the top roll 2 and two center rolls 5 and 6 are driven rolls, i.e., they are connected with a device which rotates these rolls. Driven rolls 2, 5, 6 have a common drive control 14, which drives these rolls such that the sum of the driving torque of driven rolls 2, 5, 6 is at least 100% of the power necessary to operate the calender 1. More specifically, the combined driving energy of driven rolls 2, 5, 6 is sufficient to generate enough torque to convey the paper web 21 with the required speed and tensile force through the calender 1, as if the calender had only one driven roll applying all of the driving energy. In so doing, the paper web is acted on with pressure and increased temperature in the nips between the individual rolls 2–9.

The non-driven rolls 3, 4, 8, and 9 are carried along by the paper web and the torque of driven rolls 2, 5, and 6.

Figure 2:
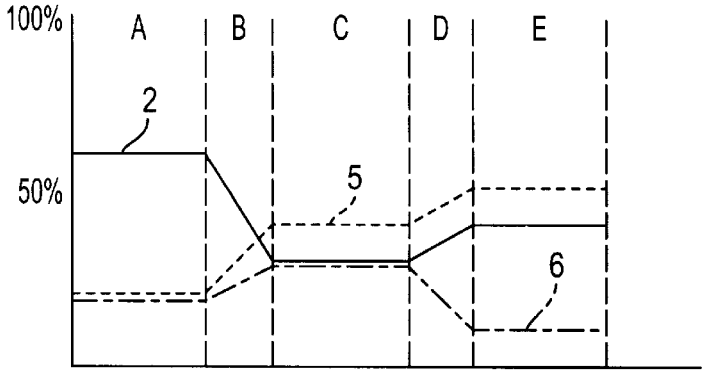
FIG. 2 shows a graph of the torque applied to driven rolls in the exemplary embodiment over periods of time.

Referring now also to FIG. 2, the driving torques of driven rolls 2, 5, and 6 are changed from time to time. For example, over a time segment A in FIG. 2, roll 2 is driven with 60% of the total torque required to operate calender 1, while rolls 5 and 6 each contribute 20% to the total driving torque. Over time segment C, roll 2 provides 30% of the driving torque, roll 5 provides 40%, and roll 6 provides 30%. Over time segment E, roll 5 provides 50% of the total driving torque, roll 2 provides 40%, and roll 6 provides 10%.

As seen by way of example in time segments B and D, the driving torques gradually transition between different levels, rather than through a sharp jump. Preferably, the absolute value of the transition slope (i.e., the rate of change between the different driving torques) must not exceed a predetermined value in order not to tear the paper web. A transition time of two seconds has proven acceptable, although higher or lower periods could be used based upon the nature of the material web and the power of the individual rollers.

It is quite possible to drive individual rolls with a negative torque, e.g., to brake them. In this instance, a roll can also be driven with more than 100% of the torque required for the operation of the calender.

A drive control 14 controls the driven rolls to change the torque as described above. Drive control 14 includes actuators 15–17 that supply power to the individual drive devices of the rolls 2, 5 and 6. A central until 18 controls actuators 15–17. The central unit 18 is connected to a random generator 19 and a timer 20. The timer 20 determines the duration of time blocks A,C, and E and transition times B and D shown in FIG. 2. The random generator 19 generates random numbers which are used to determine how to drive driven rolls 2, 5 and 6 with regard to the total driving torque in conjunction with predetermined algorithms.

An alternate form of control uses a sensor 22, which monitors the surface of a material web 21. Sensor 22 can detect the onset of barring long before the effect can be seen by the human eye. As soon as sensor 22 detects barring, a transducer 29 (connected to the sensor 22) transmits a corresponding signal to central unit 18. Central unit 18 responds by altering the driving torques, by reliance on the above-noted use of randomly generated parameters and/or prescored programs, as discussed more fully below.

An oscillation sensor 30 can also be provided to monitor oscillations in the entire device. Oscillation sensor 30 is preferably connected to a transducer 31, and mounted on frame 26 of calender 1. If the amplitude of the oscillation of the frame 26 exceeds a predetermined value, central unit 18 can change the driving torques as necessary.

Central unit 18 can also adjust the actuators 15–17 continually, for example as a function of values output by random generator 19. However, the transition rate always remains below a predetermined value. The central unit 18 thus automatically also constitutes a limiter.

A memory 32 can be provided in which one or more preset, stored, or temporarily downloaded drive torque changing programs are stored, and which adjusts the actuators 15–17 in accordance with the preset programs. The selection of programs can be fixed, or random if used in conjunction with random generator 19. Central unit 18 can also generate functions which reproduce the chronological course of the change in the driving torque distribution on the rolls 2, 5 and 6.

FIGS. 4A and 4B collectively show a table of twenty preferred sets of parameters ("parameter sets") for a calendar having six driven rolls. In this table, the first column is the number of the parameter sets (twenty), the second column is the time for which the parameter sets are used, and the remaining columns provide the specific driving parameters for each of six driven rolls. For each roll, the first column identifies the absolute power of the roll, the second column identifies the percentage of the absolute power applied to the roll, and the third column identifies the percentage of power supplied by the roll relative to the entire calender.

Central unit 18 can sequentially select each parameter set, or randomly pick among them using random generator 19. Central unit 18 can also drive the rolls for random periods of time. For such random periods of time, random generator 19 randomly outputs a value K between 0 and 1. A driving period D is set at K×24 hours. The rolls are then driven for driving period D at the determined driving torque distribution.

For purely random selection of driving torque distribution, if there are n driven rolls, then random generator 19 can assign random values to n−1 rolls. The nth roll is then set to ensure a minimum of 100% of the driving torque necessary to drive the roll machine. The period for driving these rolls may be fixed or random as described above.

As seen in FIG. 1, driven rolls 5 and 6 are adjacent or, as is the case of rolls 2 and 5, separated by two other rolls. As a result, driving torque distributions can be achieved which counteract a deflection of the rolls 2–8 perpendicular to the plane in which the rotational axes of the rolls 2–9 are disposed.

Figure 3:
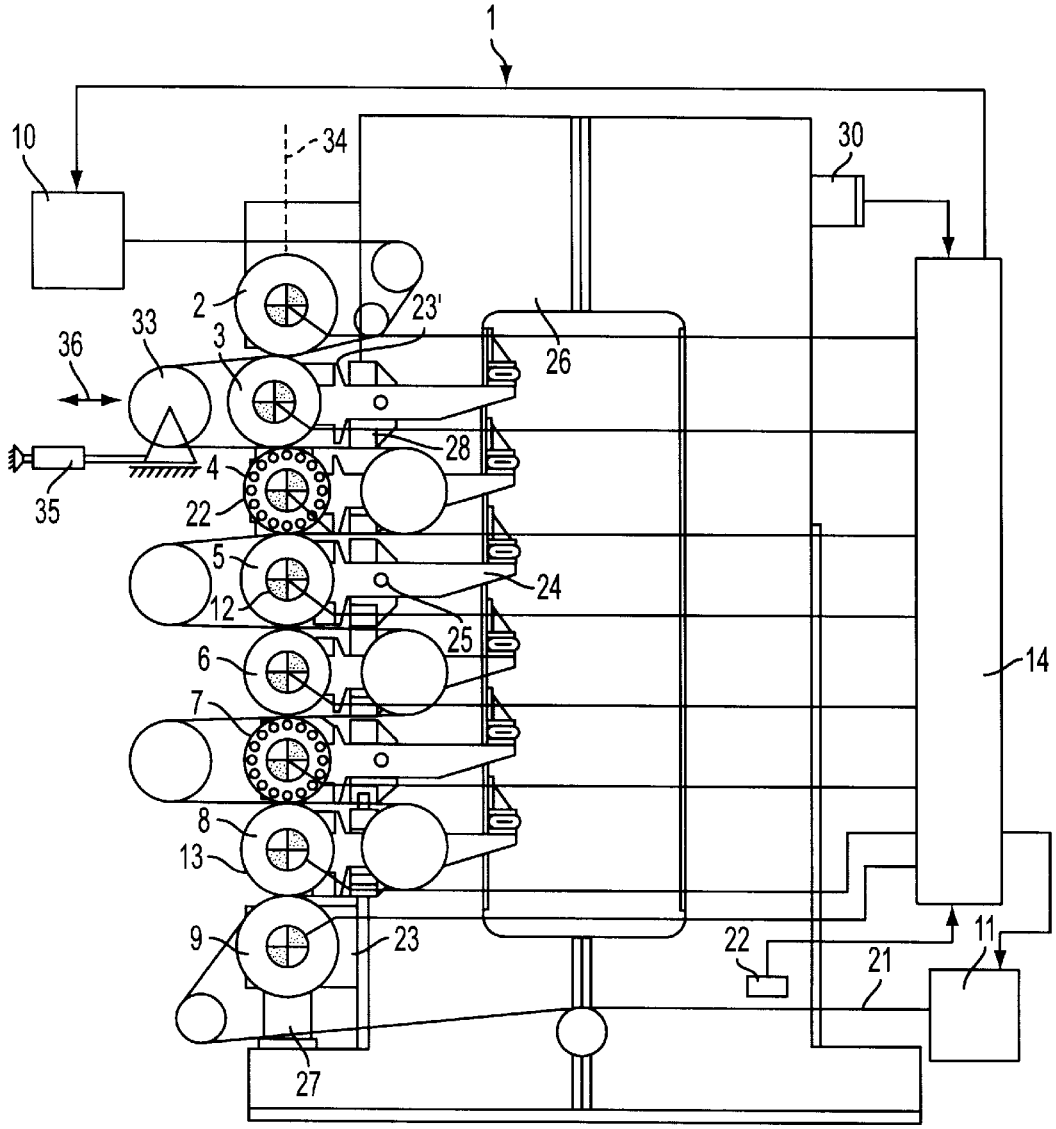
FIG. 3 shows another embodiment of a roll machine according to the present invention.

FIG. 3 shows another embodiment of the present invention. Like parts are designated with like reference numerals. FIG. 3 shows various other features for counteracting onset of barring.

In FIG. 3, drive control 14 has at least partial control over supply device 10 and receiving device 11 to control the speed of the material web 21 through calender 1.

Deflection roll 33 is movable along the direction shown by arrow 36 by a hydraulic cylinder. Movement of roll 33 changes the path between the upper and lower nips which are partially defined by roll 3. This measure is particularly effective to prevent the onset of barring caused by a periodically changing headbox of the paper making machine.

Rolls 3 and 6 are shifted laterally out of the plane as defined by the rotational axes of its two neighboring rolls 2 and 4, or 5 and 7. This also produces a slight phase shift between two nips.

As in FIG. 1, the device of FIG. 3 has a separate drive device for each driven roll under the control of drive control 14. The underlying mechanism is the same as in FIG. 1. The sum of the driving torques of the driven rolls in FIG. 3 must equal at least 100% to properly operate of the calender 1. The distribution of driving torques to the individual rolls 2–9, however, can be changed continuously, periodically, or as events dictate.

Finally, the roll stack of calender 1 can be designed so that the rolls do not all have the same diameter. Thus, for example, the heated rolls 4 and 7 can be smaller than the top roll 2 and the bottom roll 9. The two rolls 5 and 6 likewise have different diameters. Roll 3 can be larger than roll 4. This differential in diameters can also counteract the onset of barring.

The above embodiments illustrate use of the present invention in a calender, with three driven rolls, and specifically rolls 2, 5, and 6. The invention is not, however, so limited. The present invention may be used in any type of machine which uses rolls. Any number of driven rolls greater than one may be used. Different rolls can be selected as the driven rolls.

The above embodiments also illustrate the use of a fixed five time segment zone over which driving torque changes. The invention is not, however, so limited. Any number of desired zones, of any desired length, can be used. Such lengths could be preselected, or random if selected in conjunction with generator 19.

FIGS. 4A and 4B shows a preferred driving arrangement of twenty parameter sets for driving six rolls. The invention is not, however, so limited. As noted above, any number of rolls greater than one may be used. Similarly, any number of parameter sets greater than one may be used.

The particulars shown herein are by way of example and for purposes of illustrative discussion of the exemplary embodiments of the present invention only, and represents in the cause of providing what is believed to be the most useful and readily understood description of the principles and conceptual aspects of the invention. In this regard, no attempt is made to show structural details of the invention in more detail than necessary for the fundamental understanding of the invention, the description taken with the drawings making apparent to those skilled in the art how the several forms of the invention may be embodied in practice.

What is claimed is:

1. A roll machine, comprising:

a plurality of rolls disposed in a stack to define a plurality of nips therebetween adapted to treat a material web;

at least two of said plurality of rolls being driven rolls; and a drive control which commonly controls said driven rolls, said drive control varying a driving torque distribution of said driven rolls over time.

2. The roll machine of claim 1, wherein said drive control includes a random generator.

3. The roll machine of claim 1, wherein said drive control includes a limiter, said limiter maintaining a transition rate between changes of said driving torque distribution below a predetermined value.

4. The roll machine of claim 1, further comprising:

a sensor device that detects at least one of at least one property of said material web and at least one operating parameter of said roll machine, said sensor device being adapted to send at least one output signal;

said drive control changing said driving torque distribution responsive to said at least one output signal of said sensor device.

5. The roll machine of claim 1, wherein said drive control includes a timer.

6. The roll machine of claim 1, wherein said drive control has a memory in which at least one program for said driving torque distribution is stored.

7. The roll machine of claim 1, wherein said drive control has a function generator for generating a driving torque distribution based on given change function.

8. The roll machine of claim 1, wherein two of said driven rolls are provided, and are spaced apart by 2+n rolls of said plurality of rolls, wherein n is a non-negative integer.

9. The roll machine of claim 1, wherein at least one of said plurality of rolls has a different diameter than others of said plurality of rolls.

10. The roll machine of claim 1, further comprising:

a supply device that feeds said material web;

a receiving feeding device that receives said material web;

a control device that controls said supply device and said receiving device to control a speed at which said material web moves through said roll machine.

11. The roll machine of claim 1, wherein at least one roll of said plurality of rolls is disposed with its axis outside a plane defined by axes of two neighboring rolls of said plurality of rolls.

12. The roll machine of claim 1, wherein a web guide device is disposed upstream of a nip formed between two adjacent rolls of said plurality of rolls, and a distance between said web guide device and said nip is adjustable.

13. A method for operating a roll machine, said roll machine including a plurality of rolls formed in a stack to define a plurality of nips therebetween, at least two of said plurality of rolls being driven rolls, and a drive control which commonly controls said driven rolls, the method comprising:

changing a driving torque distribution of said driven rolls.

14. The method of claim 13, wherein said changing occurs while said roll machine is operating.

15. The method of claim 13, further comprising maintaining said driving torque distribution before and after said changing.

16. The method of claim 13, when said changing occurs continuously.

17. The method of claim 13, further comprising:

detecting at least one property of said roll machine; and said changing occurring responsive to said detecting identifying an irregularity in said at least one property.

18. The method of claim 13, wherein a transition speed of said changing does not exceed a predetermined value.

19. The method of claim 13, further comprising randomly determining another drive torque distribution, wherein said changing changes a current driven torque distribution to said another driving torque distribution.

20. The method of claim 13, further comprising adjusting a speed of said material web through said roll machine.

21. A roll machine, comprising:

a plurality of rolls defining a plurality of nips, at least two of said rolls being driven rolls; and a drive control, said driving control setting at least first and second driving torque distributions for said driven rolls; and wherein, for each of said at least first and second torque distributions, said driving control causes each of said driven rolls to operate at a driving torque which is less then 100% of torque necessary to properly operate said roll machine, and to collectively operate at a driving torque which is at least 100% of torque necessary to properly operate said roll machine.

22. The roll machine of claim 21, wherein said drive control drives said driven rolls at said first driving torque distribution for a first period of time, and then controls said driven rolls at said second driving torque distribution for a second period of time.

23. The roll machine of claim 22, wherein said plurality of rolls at least transport a material web, said first and second periods of time are separated by a third period of time, said third period of time being long enough to allow said driven rolls to change from said first driving torque distribution to said second driving torque distribution without damaging said material web.

24. The roll machine of claim 21, said driving control including a random generator, at least one of said first and second driving torque distributions being at least partially based on an output of said random generator.

25. A roll machine for at least moving a material web, comprising:

a plurality of rolls, including at least first and second driven rolls, said rolls defining a plurality of nips; and said at least first and second rolls collectively providing at least sufficient torque to properly move said material web through said roll machine, and individually providing at least a portion of said at least sufficient torque;

wherein a torque provided by each of said first and second driven rolls changes over time.

26. A method for operating a roll machine for at least moving a material web, said roll machine comprising a plurality of rolls including at least two driven rolls, the rolls defining a plurality of nips, said method comprising:

collectively driving said at least two driven rolls to provide at least a proper operating torque required to properly move said material web through said roll machine;

distributing said at least proper operating torque amongst said at least two driven rolls, wherein each of said at least two driven rolls provides at least a portion of said proper operating torque;

redistributing said proper operating torque amongst said at least two driven rolls, wherein each of said at least two driven rolls provides at least a portion of said proper operating torque, such that at least one of said at least two driven rolls provides a different amount of torque than before said redistribution.

27. The method of claim 26, further comprising:

detecting whether an abnormal condition exists; and said second establishing being responsive to a positive output of said detecting.

28. The method of claim 26, wherein said first driving occurs over a first period of time, said second driving occurs over a second period of time, and said transitionally driving occurs over a third period of time between said first and second periods of time, said third period of time being sufficiently long to prevent damage to said material web.

29. The method of claim 28, wherein at least one of said first and second periods of time is predetermined.

30. The method of claim 28, wherein at least one of said first and second periods of time is variable.

31. The method of claim 26, wherein said first and second driving occur continuously.

32. A method for operating a roll machine for at least moving a material web, said roll machine comprising a plurality of rolls including at least two driven rolls, the rolls defining a plurality of nips, said method comprising:

establishing a first driving torque distribution between said at least two rolls such that said at least two driven rolls collectively provide at least a proper operating torque required to properly move said material web through said roll machine, and individually provide at least a portion of said proper operating torque;

driving said at least two driven rolls in accordance with said first driving torque distribution;

establishing a second driving torque distribution between said at least two rolls such that said at least two driven rolls collectively provide at least a proper operating torque required to properly move said material web through said roll machine, and individually provide at least a portion of said proper operating torque;

transitionally driving said at least two driven rolls from said first driving torque distribution to said second driving torque distribution; and second driving said at least two driven rolls in accordance with said second driving torque distribution;

wherein said first and second driving torques differ such that at least one of said at least two driven rolls is driven at different torques during said first and second driving.

33. The method of claim 32, wherein at least one of said establishing said first driving torque distribution and said establishing said second driving torque distribution is based at least partially on randomly generated parameters.

34. A method for operating a roll machine for at least moving a material web, said roll machine comprising a plurality of rolls including at least two driven rolls, the rolls defining a plurality of nips, said method comprising:

establishing a driving torque distribution, such that said at least two driven rolls collectively provide a proper operating torque to operate said roll machine, and individually provide at least a portion of said proper operating torque; and establishing a driving torque distribution, such that said at least two driven rolls provide at least a portion of said proper operating torque; and changing said driving torque distribution over time.

* * * * *